US009353631B2

(12) United States Patent
Spangler

(10) Patent No.: US 9,353,631 B2
(45) Date of Patent: May 31, 2016

(54) GAS TURBINE ENGINE AIRFOIL BAFFLE

(75) Inventor: Brandon W. Spangler, East Hartford, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 806 days.

(21) Appl. No.: 13/214,429

(22) Filed: Aug. 22, 2011

(65) Prior Publication Data

US 2013/0052008 A1 Feb. 28, 2013

(51) Int. Cl.
*F01D 5/18* (2006.01)

(52) U.S. Cl.
CPC ..... *F01D 5/186* (2013.01); *F01D 5/189* (2013.01); *F05D 2260/201* (2013.01); *F05D 2260/202* (2013.01)

(58) Field of Classification Search
CPC ..... F01D 9/06; F01D 9/065; F01D 25/12; F01D 5/186; F01D 5/189; F05D 2240/12; F05D 2260/20; F05D 2240/201; F05D 2240/202
USPC ..... 415/115, 116; 416/1, 90 R, 96 A, 97 R, 416/224, 95
See application file for complete search history.

(56) References Cited

U.S. PATENT DOCUMENTS

| | | | | | |
|---|---|---|---|---|---|
| 2,787,441 | A | * | 4/1957 | Bartlett | 416/92 |
| 3,806,276 | A | * | 4/1974 | Aspinwall | 416/97 R |
| 3,930,748 | A | * | 1/1976 | Redman et al. | 416/97 R |
| 5,193,975 | A | | 3/1993 | Bird et al. | |
| 5,253,976 | A | * | 10/1993 | Cunha | 415/114 |
| 5,516,260 | A | * | 5/1996 | Damlis et al. | 415/115 |
| 5,533,864 | A | * | 7/1996 | Nomoto et al. | 416/96 A |
| 5,586,866 | A | * | 12/1996 | Wettstein | 416/96 A |
| 5,591,002 | A | * | 1/1997 | Cunha et al. | 415/115 |
| 5,634,766 | A | * | 6/1997 | Cunha et al. | 415/115 |
| 5,743,708 | A | * | 4/1998 | Cunha et al. | 415/115 |
| 6,019,572 | A | * | 2/2000 | Cunha | 415/114 |
| 6,135,715 | A | | 10/2000 | Correia | |
| 6,283,708 | B1 | | 9/2001 | Zelesky | |
| 6,431,824 | B2 | * | 8/2002 | Schotsch et al. | 415/115 |
| 6,511,293 | B2 | | 1/2003 | Widrig et al. | |
| 6,517,312 | B1 | * | 2/2003 | Jones et al. | 415/115 |
| 6,805,533 | B2 | | 10/2004 | Schopf | |
| 7,527,470 | B2 | * | 5/2009 | Guimbard et al. | 415/115 |
| 7,556,476 | B1 | | 7/2009 | Liang | |
| 2009/0238675 | A1 | | 9/2009 | Cunha et al. | |
| 2010/0221123 | A1 | * | 9/2010 | Pal et al. | 416/97 R |
| 2011/0123311 | A1 | | 5/2011 | Devore et al. | |

* cited by examiner

*Primary Examiner* — Sean J Younger
(74) *Attorney, Agent, or Firm* — Carlson, Gaskey & Olds, P.C.

(57) ABSTRACT

An airfoil includes an airfoil wall having an exterior airfoil surface and an interior surface. The interior surface provides an airfoil cavity. A baffle is arranged in the airfoil cavity and provides a baffle wall having first and second portions spaced from one another on first and second sides. A tube interconnects the first and second portions and is configured to convey fluid through the tube between the first and second sides. The airfoil is cooled by supplying cooling fluid to a baffle arranged within an airfoil. The cooling fluid is passed through baffle cooling holes to a gap between the baffle and airfoil to cool an interior surface of the airfoil. A portion of cooling fluid is conveyed from one gap location to another gap through a tube in the baffle. Another portion of the cooling fluid is passed through film cooling holes in the airfoil.

13 Claims, 2 Drawing Sheets

GAS TURBINE ENGINE AIRFOIL BAFFLE

BACKGROUND

This disclosure relates to a gas turbine engine airfoil and airfoil baffle. This disclosure also relates to a method of supplying a cooling fluid flow to an airfoil.

Turbine vanes, such as first stage vanes in a gas turbine engine, experience high external heat loads that require high levels of cooling. Typically, numerous film cooling holes and high volumes of cooling fluid are required to provide the needed airfoil cooling. One or more baffles are typically provided within an internal cavity of the airfoil. Cooling fluid is supplied to the baffle, which is spaced from the airfoil. Baffle cooling holes direct cooling fluid onto an internal surface of the airfoil. This cooling fluid then exits the airfoil through film cooling holes to provide a film on the airfoil exterior surface.

Typically compressor bleed air is used to provide the cooling fluid. The volume of cooling fluid used to cool engine components impacts the efficiency of the engine.

SUMMARY

An airfoil includes an airfoil wall having an exterior airfoil surface and an interior surface. The interior surface provides an airfoil cavity. A baffle is arranged in the airfoil cavity and provides a baffle wall having first and second portions spaced from one another on first and second sides. A tube interconnects the first and second portions and is configured to convey fluid through the tube between the first and second sides.

A baffle for an airfoil includes a baffle wall having spaced apart concave and convex portions bounding a baffle cavity and provides an exterior baffle surface. Tubes are arranged in the baffle cavity and interconnecting the concave and convex portions. The tube is configured to convey fluid between opposing exterior baffle surfaces.

A method of cooling an airfoil includes supplying cooling fluid to a baffle arranged within an airfoil. The cooling fluid is passed through baffle cooling holes to a gap between the baffle and airfoil to cool an interior surface of the airfoil. A portion of cooling fluid is conveyed from one gap location to another gap location remote from the one gap location through a tube in the baffle. Another portion of the cooling fluid is passed through film cooling holes in the airfoil.

BRIEF DESCRIPTION OF THE DRAWINGS

The disclosure can be further understood by reference to the following detailed description when considered in connection with the accompanying drawings wherein.

DETAILED DESCRIPTION

Figure 1:
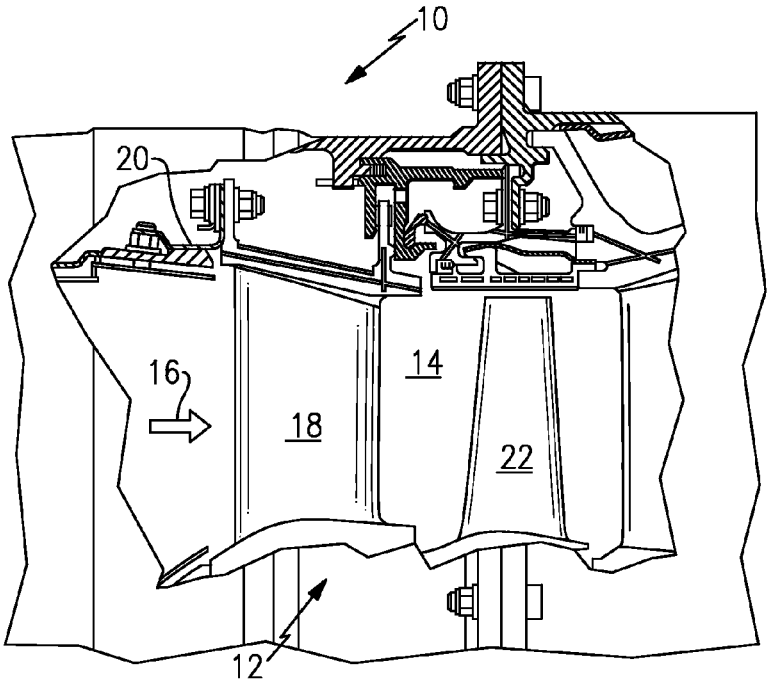
FIG. 1 is a partial schematic view of a gas turbine engine.

A gas turbine engine (GTE) 10 is schematically illustrated in FIG. 1. The GTE includes a turbine section 12 having a gas flow path 14. A fluid 16 moves through the gas flow path 14. An array of airfoils 18, such as turbine stator vanes, is arranged within the flow path 14. The airfoils 18 are secured to an outer case 20 in the example. An array of rotor blades 22 is arranged within the flow path 14 and is rotationally driven by the fluid 16.

Figure 2:
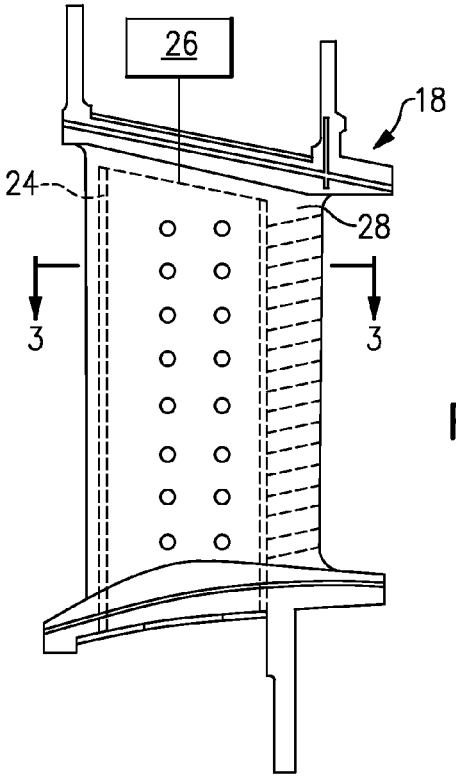
FIG. 2 is a schematic view of an example airfoil.

Referring to FIG. 2, the airfoil 18 includes an internally arranged baffle 24 that receives a cooling fluid from a fluid source 26, such as compressor bleed air. The airfoil 18 includes an airfoil wall 28 that provides an exterior airfoil surface 30 and an interior surface 32 providing an airfoil cavity 34, best illustrated in FIG. 3. The baffle 24 is arranged within the airfoil cavity 34.

Figure 3:
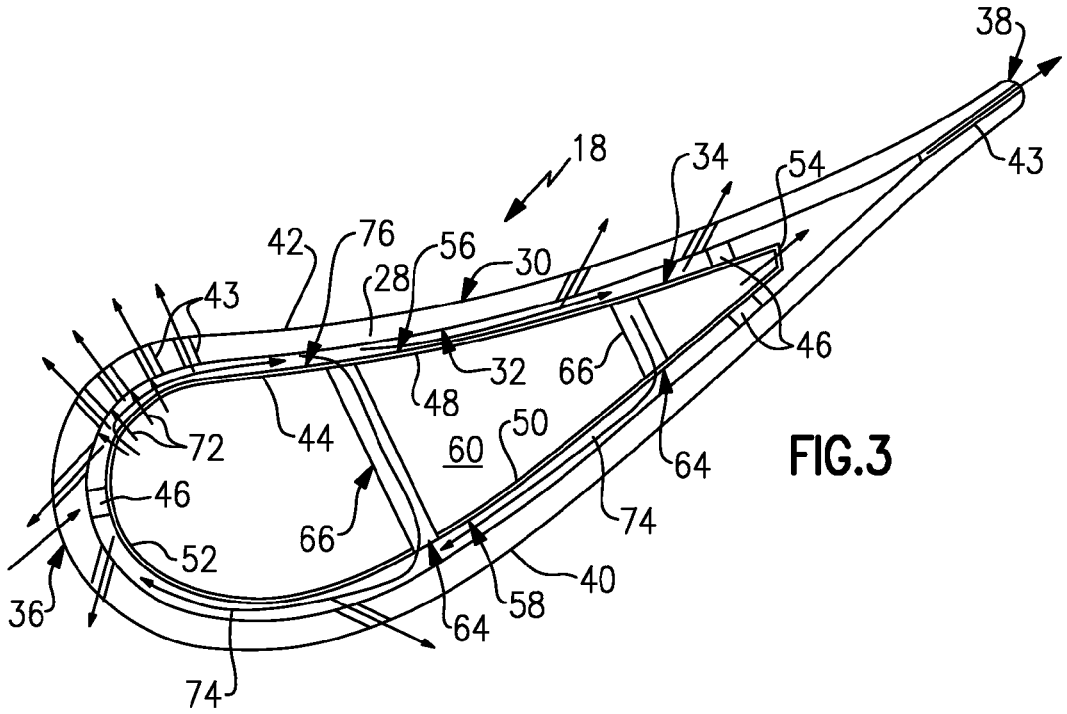
FIG. 3 is a cross-sectional view of the airfoil shown in FIG. 2 taken along line 3-3.
Figure 4:
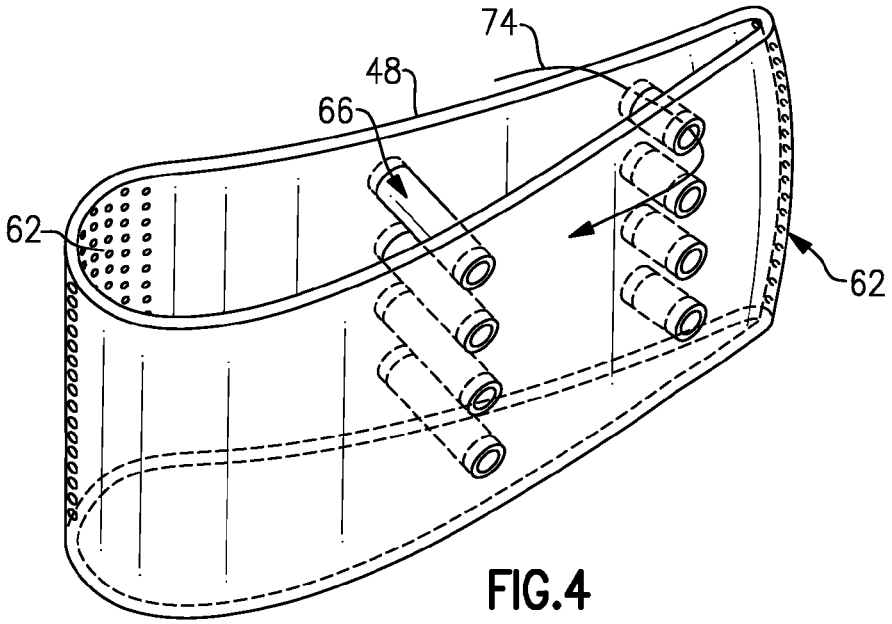
FIG. 4 is a perspective view of a portion of a baffle illustrated in FIG. 3.

With continuing reference to FIG. 3, the airfoil 18 includes leading and trailing edges 36, 38 adjoining one another by spaced apart suction and pressure sides 40, 42. The suction side 40 is provided by a convex surface, and the pressure side 42 is provided by a concave surface. The airfoil wall 28 includes film cooling holes 43 that provide a cooling film along the exterior airfoil surface 30 with the cooling fluid from the fluid source 26, which enables the airfoil 18 to withstand high operating temperatures.

The baffle 24 provides by a baffle wall 44. The baffle 24 is supported within the airfoil cavity 34 by standoffs 46 provided along the interior surface 32 in the example, which provides a gap 76 between the airfoil 18 and the baffle 24. In one example, the standoffs 46 are 0.030-0.100" (0.76-2.54 mm) proud of the adjoining interior surface 32. In one example, the baffle wall 44 engages the standoffs 46 or is spaced slightly from the standoffs 46 around 0.005" (0.13 mm). The standoffs 46 extend radially along the airfoil 18 and act as a barrier to prevent fluid in the gap 76 from passing between the pressure and suction sides. As a result, airflow is forced through the baffle 24, as is discussed in more detail below.

The baffle wall 44 includes first and second portions 48, 50, which are respectively concave and convex, adjoining first and second ends 52, 54, which together round a baffle cavity 60. The shape of a baffle exterior surface 70 is similar to the interior surface 32 of the airfoil 18 for efficient convection cooling. The first and second portions 48, 50 are spaced apart from one another and are provided on first and second sides 56, 58 that are respectively adjacent the suction and pressure sides 40, 42.

The baffle cavity 60 receives cooling fluid from the fluid source 26. Baffle cooling holes 62 are provided in the baffle wall 44 to communicate cooling fluid from the baffle cavity 60 to the gap 76, providing convection cooling to the interior surface 32.

Figure 5:
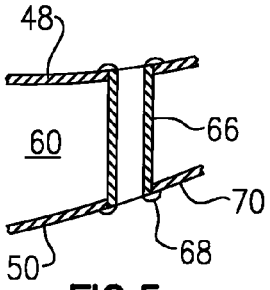
FIG. 5 is a partial cross-sectional view of the airfoil illustrated in FIG. 3.

Bypass holes 64 are provided in the first and second portions 48, 50. Tubes 66 are aligned with the bypass holes 64 and interconnect the first and second portions 48, 50. The tubes 66 are configured to convey the cooling fluid from the first side 56 to the second side 58. In one example, a securing material 68, such as a weld, secures the tube 66 to the baffle 24, as best shown in FIG. 5. However, the tubes may be fastened by other means, such as a rivet. In one example, the ends of the tubes 66 extend to the exterior surface 70 of the baffle 24 and may be ground flush with the exterior surface 70.

In one example, the tube 66 are cylindrical conduits and do not have any perforations such that the cooling fluid passes from the first side 56 to the second side 58 without entering the baffle cavity 60. It should be understood, however, that the tubes may have any suitable cross-sectional shape, such as oval, elliptical, racetrack, and polygonal, for example.

In operation, the cooling fluid is provided from the fluid source 26 to the baffle cavity 60. A baffle cooling flow 72 exits the baffle cooling holes 62 and flows into the gap 76 to provide convection cooling to the interior surface 32. One set of standoffs 46 force cooling air to exit the baffle 24 though the baffle cooling hole 62 in the trailing edge, and air in the gap at the suction and pressure sides is prevented from flowing to the trailing edge film cooling hole 43 in the airfoil 18 by standoffs 46. One or more additional standoffs 46 separates cooling fluid in the gap on the pressure and suction sides. A portion of the baffle cooling flow 72 exits the film cooling holes 43 to provide a cooling film along the exterior airfoil surface 30.

Another portion of the baffle cooling flow 72 from the gap 76 passes through the tubes 66 as a bypass flow 74 from the first side 56, which is adjacent the pressure side 42, to the second side of 58, which is adjacent the suction side 40. The tubes 66 enable cooling fluid to pass from the pressure side to the suction side without mixing with cooling fluid within the baffle cavity 60. The size, number, shape and position of the tubes 66 can be configured as desired to balance heat transfer with pressure drop. The tubes 66 and standoffs 46, which isolate the pressure and suction sides within the airfoil 18, increases convection cooling within the airfoil 18. As a result, some of the film cooling holes 43 can be eliminated, which can reduce the amount of cooling flow needed from the cooling source.

Although an example embodiment has been disclosed, a worker of ordinary skill in this art would recognize that certain modifications would come within the scope of the claims. For that reason, the following claims should be studied to determine their true scope and content.

What is claimed is:

1. An airfoil comprising:

an airfoil wall providing an exterior airfoil surface and an interior surface, the interior surface providing an airfoil cavity with concave and convex surfaces respectively corresponding to pressure and suction sides;

a baffle arranged in the airfoil cavity and providing a baffle wall having first and second portions spaced from one another on first and second sides that are respectively concave and convex to define a gap therebetween;

a plurality of standoffs arranged between the interior surface and baffle wall to isolate a first gap portion and a second gap portion;

baffle cooling holes are arranged in the first portion to convey a fluid between the baffle and the first gap portion;

a tube interconnecting the first and second portions; and wherein the tube is configured to convey fluid between first and second gap portions, the first gap portion is arranged between the concave surface and the first side, the second gap portion is arranged between the convex surface and the second side.

2. The airfoil according to claim 1, wherein the plurality of stand-offs are arranged between the interior surface and the baffle wall to provide the gap.

3. The airfoil according to claim 2, wherein the airfoil wall includes film cooling holes, the airfoil is configured to convey cooling fluid through the baffle and out the baffle cooling holes to the film cooling holes, and the plurality of standoffs isolate pressure and suction sides of the gap from one another.

4. The airfoil according to claim 2, wherein the plurality of stand offs extend radially along the airfoil.

5. The airfoil according to claim 1, wherein the first and second portions include bypass holes, and the tube interconnects the bypass holes.

6. The airfoil according to claim 5, wherein the tube is flush with an exterior baffle surface provided by the baffle wall.

7. The airfoil according to claim 5, wherein a weld secures the tube to the exterior baffle surface at least one of the bypass holes.

8. The airfoil according to claim 5, wherein the tube is secured to the baffle by riveting.

9. The airfoil according to claim 1, wherein the tube is arranged substantially perpendicularly relative to the first and second portions.

10. The airfoil according to claim 1, wherein the tube is an imperforate conduit configured to convey a bypass flow from the first gap portion to the second gap portion.

11. The airfoil according to claim 1, wherein the tube is cylindrical.

12. The airfoil according to claim 1, wherein the first and second gap portions are defined respectively by the first and second portions and the concave and convex surfaces.

13. A method of cooling an airfoil comprising the steps of:

supplying cooling fluid to a baffle arranged within an airfoil;

passing the cooling fluid through baffle cooling holes to a first gap portion between the baffle and airfoil to cool an interior surface of the airfoil;

conveying a portion of cooling fluid from the first gap portion to a second gap portion remote from the first gap portion through a tube in the baffle;

passing another portion of the cooling fluid through film cooling holes in the airfoil; and wherein the first gap portion and the second gap portion are respectively adjacent to suction and pressure sides provided by an exterior surface of said airfoil, the first and second gap portions fluidly isolated from one another by standoffs arranged between the interior surface and the baffle.

* * * * *